United States Patent [19]

Klimpel et al.

[11] Patent Number: 4,761,223

[45] Date of Patent: Aug. 2, 1988

[54] FROTHERS DEMONSTRATING ENHANCED RECOVERY OF FINE PARTICLES OF COAL IN FROTH FLOTATION

[75] Inventors: Richard R. Klimpel; Robert D. Hansen, both of Midland, Mich.

[73] Assignee: The Dow Chemical Company, Midland, Mich.

[21] Appl. No.: 646,340

[22] Filed: Aug. 29, 1984

[51] Int. Cl.[4] ..... B03D 1/14

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,695,101 | 11/1954 | Booth et al. . | |
| 2,724,499 | 11/1955 | Smith . | |
| 2,950,818 | 8/1960 | Moeller . | |
| 2,965,678 | 12/1960 | Sundberg et al. . | |
| 3,078,236 | 2/1963 | Hwa . | |
| 3,595,390 | 7/1971 | Booth . | |
| 3,710,939 | 1/1973 | Hostynek et al. . | |
| 4,211,644 | 7/1980 | Wiechers . | |
| 4,439,314 | 3/1984 | Parlman et al. | 209/167 |
| 4,476,013 | 10/1984 | McCaffrey | 209/166 |

OTHER PUBLICATIONS

Gaylord, N. G., Polyethers Interscience, publishers Division of John Wiley & Sons, pp. 225–230, 11/26/63.

*Primary Examiner*—Bernard Nozick

[57] ABSTRACT

The invention is a process for recovering coal from raw coal which comprises subjecting the raw coal in the form of an aqueous pulp, to a flotation process in the presence of a flotation collector, and a flotating amount of a flotation frother which comprises the reaction product of a polyhydroxy $C_{1-20}$ alkane or polyhydroxy $C_{3-20}$ cycloalkane and propylene oxide, or a mixture of propylene oxide and ethylene oxide, with the proviso that at least 50 mole percent of the mixture is propylene oxide, and the reaction product has a molecular weight of between about 150 and 1400, under conditions such that the coal is recovered.

1 Claim, No Drawings

FROTHERS DEMONSTRATING ENHANCED RECOVERY OF FINE PARTICLES OF COAL IN FROTH FLOTATION

BACKGROUND OF THE INVENTION

This invention relates to novel froth flotation frothers which demonstrate enhanced recovery of fine particles of coal in froth flotation.

Froth flotation is a commonly employed process for concentrating minerals from ores and coal values from raw coal. In a flotation process, the ore or raw coal is crushed and wet ground to obtain a pulp. A frothing agent, usually employed with a collecting agent, is added to the ore or raw coal to assist in separating valuable minerals or coal from the undesired or gangue portions of the ore or raw coal in subsequent flotation steps. The pulp is then aerated to produce a froth at the surface thereof and the collector assists the frothing agent in separating the mineral or coal values from the ore or raw coal by causing the mineral or coal values to adhere to the bubbles formed during this aeration step. The adherence of the mineral or coal values is selectively accomplished so that the portion of the ore or raw coal not containing mineral or coal values does not adhere to the bubbles. The mineral- or coal-bearing froth is collected and further processed to obtain the desired mineral or coal values. That portion of the ore or raw coal which is not carried over with the froth, usually identified as "flotation tailings", is usually not further processed for extraction of mineral or coal values therefrom. The froth flotation process is applicable to ores containing metallic and nonmetallic mineral values and to coal.

In flotation processes, it is desirable to recover as much coal or mineral values as possible from the raw coal or ore while effecting the recovery in a selective manner, that is, without carrying over undesirable portions of the raw coal or ore in the froth.

While a large number of compounds have foam or froth producing properties, the frothers most widely used in commercial froth flotation operations are monohydroxylated compounds such as $C_{5-8}$ alcohols, pine oils, cresols and $C_{1-4}$ alkyl ethers of polypropylene glycols as well as dihydroxylates such as polypropylene glycols. The frothers most widely used in froth flotation operations are compounds containing a nonpolar, water-repellent group and a single, polar, water-avid group such as hydroxyl (OH). Typical of this class of frothers are mixed amyl alcohols, methylisobutyl carbinol, hexyl and heptyl alcohols, cresols, terpineol, etc. Other effective frothers used commercially are the $C_{1-4}$ alkyl ethers of polypropylene glycol, especially the methyl ether and the polypropylene glycols of 140–2100 molecular weight and particularly those in the 200–500 range. In addition, certain alkoxyalkanes, e.g., triethoxybutane, are used as frothers in the flotation of certain ores.

Although mineral or coal value recovery improvements from a preferred frother in the treatment of an ore or raw coal can be as low as only about 1 percent over other frothers, this small improvement is of great importance economically since commercial operations often handle as much as 50,000 tons of ore or raw coal daily. With the high throughput rates normally encountered in commercial flotation processes, relatively small improvements in the rate of mineral or coal recovery result in the recovery of additional tons of mineral or coal values daily. Obviously then, any frother which promotes improved mineral or coal value recovery, even though small, is very desirable and can be advantageous in commercial flotation operations.

It is well-known in the practice of froth flotation, that the recovery of fine (slime) particles of coal with reasonable selectivity toward the valuable coal over the gangue (ash) is quite difficult. Normally the problem is not one of achieving high recovery of the valuable component, but rather one of accepting much lower than desired valuable recovery so as to achieve a fines valuable product of an acceptable quality or grade (selectivity). In practice, it is normally found that as the valuable recovery of fines is increased, the quality of the flotation product (selectivity) dramatically decreases. Thus, an economic optimization occurs between increasing the amount of recovered valuable material versus the drop in product value with the decreasing product grade.

What is needed is a process for the enhanced recovery of fine particles of coal by froth flotation. What are further needed are frothers which enhance the recovery of fine particles of coal in froth flotation processes.

SUMMARY OF THE INVENTION

The invention is a process for recovering coal from raw coal which comprises subjecting the raw coal in the form of an aqueous pulp, to a flotation process in the presence of a flotation collector, and a flotating amount of a flotation frother which comprises the reaction product of a polyhydroxy $C_{1-20}$ alkane or a polyhydroxy $C_{3-20}$ cycloalkane and propylene oxide, or a mixture of propylene oxide and ethylene oxide, with the proviso that at least 50 mole percent of the mixture is propylene oxide, and the reaction product has a molecular weight of between about 150 and 1400, under conditions such that the coal is recovered in the froth.

Another aspect of this invention is a two-step process, wherein raw coal is subjected to a known froth flotation process to recover the coal values. Thereafter in a second step, the tailings which generally comprise the gangue and unrecovered fine particles of coal, is exposed to a froth flotation process in the presence of the reaction product of a polyhydroxy $C_{1-20}$ alkane or a polyhydroxy $C_{3-20}$ cycloalkane and propylene oxide or propylene oxide and ethylene oxide mixture, under conditions such that the fine coal values are selectively floated.

The process of this invention results in a surprisingly high recovery of fine coal values with a high selectivity toward the coal values over the ash.

DETAILED DESCRIPTION OF THE INVENTION

The process of this invention results in enhanced recovery of fine coal values. Critical to this enhanced recovery are the frothers used in the process. These frothers are useful for floating coal of all particle sizes, and when used result in enhanced recovery of the fine particle sized coal. Furthermore, the frothers can be used in a process wherein only fine particles are subjected to the froth flotation process and result in enhanced selectivity toward the fine coal values over the ash.

The frothers useful in this invention comprise the reaction product of a polyhydroxy $C_{1-20}$ alkane or polyhydroxy $C_{3-20}$ cycloalkane and propylene oxide or a mixture of propylene and ethylene oxide, wherein the molecular weight of the reaction product is between about 150 and 1400; with the proviso that when a mixture of ethylene oxide and propylene oxide is used, at least 50 mole percent of the mixture is propylene oxide.

Preferably, the reaction product has a molecular weight of between about 200 and 800. Most preferably, the reaction product has a molecular weight of between 250 and 500. In preferred embodiments, the reaction product corresponds to the formula

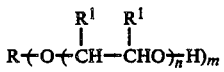

wherein R is a $C_{1-20}$ alkane or $C_{3-20}$ cycloalkane radical; $R^1$ is hydrogen or methyl; m is an integer of between 3 and 10; and n is a real number of between about 1 and 8; with the proviso that each ether unit can contain only one methyl group, and with the further proviso that at least 50 percent of the ether units must have one methyl group.

Any polyhydroxy $C_{1-20}$ alkane or polyhydroxy $C_{1-20}$ cycloalkane which will react with propylene oxide, or a mixture of ethylene oxide and propylene oxide, can be used in this invention. Polyhydroxy $C_{3-12}$ alkanes or polyhydroxy $C_{3-12}$ cycloalkanes are preferred. Polyhydroxy $C_{3-6}$ alkanes or polyhydroxy $C_{5-8}$ cycloalkanes are more preferred with trihydroxy propanes being most preferred. The polyhydroxy alkanes useful in this invention include those which correspond to the formula $R—OH)_m$ wherein R and m are as hereinbefore defined. Suitable polyhydroxy alkanes include the trihydroxy ethanes, trihydroxy propanes, trihydroxy butanes, trihydroxy pentanes, trihydroxy hexanes, trihydroxy heptanes, trihydroxy octanes, diglycerol, sorbitol, pentaerythritol, a monosaccharide, a disaccharide, sucrose or mixtures thereof. More preferred polyhydroxy alkanes include the trihydroxy propanes, trihydroxy butanes, trihydroxy pentanes, and trihydroxy hexanes. A most preferred triol is 1,2,3-trihydroxy propane. Poly refers herein to 3 or more. The polyhydroxy alkanes include $C_{1-20}$ alkanes containing between 3 and 10 hydroxyl moieties, inclusive, more preferably between 3 and 8 hydroxyl moieties, inclusive, even more preferably between 3 and 6 hydroxyls, inclusive, and most preferably 3 hydroxyls.

The polyhydroxy $C_{1-20}$ alkanes or polyhydroxy $C_{3-20}$ cycloalkanes are reacted with either propylene oxide or a mixture of ethylene and propylene oxide wherein such mixture contains at least 50 mole percent of propylene oxide. The alkylene oxide generally correspond to the formula

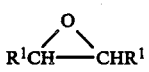

wherein $R^1$ is as hereinbefore defined, with the proviso that only one $R^1$ can be methyl. Preferably, the $C_{1-20}$ polyhydroxy alkane or polyhydroxy $C_{3-20}$ cycloalkane is reacted with propylene oxide. In the hereinbefore presented formulas, R is preferably a $C_{3-12}$ alkane or $C_{3-12}$ cycloalkane radical, more preferably $C_{3-6}$ alkane or $C_{5-8}$ cycloalkane, and most preferably a $C_3$ alkane radical. Preferably, m is an integer of about 3 to 8; more preferably an integer of about 3 to 6 and most perferably 3. Preferably, n is between about 1 and 4, and most preferably between about 1 and 3.

The frothers of this invention can be prepared by contacting a polyhydroxy $C_{1-20}$ alkane or a polyhydroxy $C_{3-20}$ cycloalkane with the appropriate molar amount of propylene oxide, or mixture of ethylene oxide and propylene oxide, in the presence of an alkali catalyst such as an alkali metal hydroxide, an amine, or boron trifluoride. Generally, between about 0.5 and 1 percent of the total weight of the reactants of the catalyst can be used. In general, temperatures of up to 150° C. and pressures of up to 100 psi can be used for the reaction. In that embodiment wherein a mixture of propylene and ethylene oxide is being used, the propylene and ethylene oxide may be added simultaneously or in a sequential manner.

The polyhydroxy $C_{1-20}$ alkane or polyhydroxy $C_{3-20}$ cycloalkane is reacted with a sufficient amount of propylene oxide or a mixture of ethylene oxide and propylene oxide so as to prepare a reaction product of the desired molecular weight, in particular, between about 150 and 1400, more preferably between about 200 and 800, and most preferably between about 250 and 500.

Poly refers herein to 3 or more. Ether unit refers herein to the residue of ethylene oxide or propylene oxide in the reaction product, and in a preferred embodiment corresponds to the formula

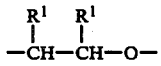

wherein $R^1$ is as hereinbefore defined.

As described hereinbefore, the process of this invention can be used either to beneficiate raw coal which contains fine particle sized coal, or it can be used to beneficiate a raw coal which is totally of a fine particle size, such as the tailings from a previous froth flotation process. Generally, fine particle size coal refers herein to coal of a particle size less than 90 micrometers (−170 mesh Tyler). In many places in the art, fine particle size coals are referred to as slimes.

The process of this invention is useful for the recovery by froth flotation of coal values from raw coal. Raw coal refers herein to coal in its condition as taken out of the ground, in that the raw coal contains both the valuable coal and what is known in the art as gangue. Gangue refers herein to those materials which are of no value and need to be separated from the coal. Often the gangue is referred to as ash by those skilled in the art.

The amount of the frother used for froth flotation depends upon the type of ore used, the grade of ore, the size of the ore particles and the particular frother used. Generally, that amount which separates the desired coal from the raw coal is used. Preferably between about 0.005 and 0.5 lb/ton (0.0025 and 0.25 kg/metric ton) can be used. Most preferably, between about 0.01 and 0.2 lb/ton (0.005 and 0.1 kg/metric ton) are used. The froth flotation process of this invention, usually requires the use of collectors. Any collector well-known in the art, which results in the recovery of the desired coal is suitable. Further, in the process of this invention it is contemplated that the frothers of this invention can be used in mixtures with other frothers known in the art.

Frothers known in the art as useful for the froth flotation of coal values from raw coal include conventional frothers, such as pine oil, cresol, $C_{4-8}$ alkanols containing one or two tertiary aryl or one quaternary carbon atom, e.g., isomers of amyl alcohol, are suitable for this purpose. However, methyl isobutyl carbinol and polypropylene glycol alkyl or phenyl ethers are preferred as frothers, with polypropylene glycol methyl ethers having a weight average molecular weight between about 200 and about 600 being most preferred.

For the flotation of coal values from raw coal, fuel oil is employed in the flotation medium as a collector. Representative fuel oils include diesel oil, kerosene, bunker C fuel oil, and mixtures thereof. The fuel oil can generally be advantageously employed in a ratio of from about 0.02 to about 2.5 kg of fuel oil per 100 kg of coal flotation feed.

The coal to be floated by the instant process can suitably be anthracite, bituminous or subbituminous.

The size of the coal particles to be separated by flotation is important as generally particles larger than about 28 mesh (U.S. Sieve Size) are difficult to float. In typical operations, coal particles larger than 28 mesh, advantageously larger than 100 mesh, are separated from both the inert material mined therewith and more finely divided coal by gravimetric separation techniques. However, if a substantial fraction of the coal in the flotation feed comprises particles larger than 28 mesh, it is desirable that the feed be comminuted further prior to flotation.

The sized coal flotation feed optionally is first washed and then mixed with sufficient water to prepare an aqueous slurry having a solids concentrate which promotes rapid flotation. Generally, a solids concentration between about 2 to about 20 weight percent solids, more preferably from about 5 to about 10 weight percent, is preferred. The aqueous coal slurry is advantageously conditioned with the condensation product, a frother, fuel oil and any other adjuvants by mixing with the slurry in a manner known to the art. The frother, however, should be introduced to the slurry shortly before or during flotation to provide maximum frothing.

The coal is operably floated at the natural pH of the coal in the aqueous slurry, which can vary from about 3.0 to about 9.5 depending upon the composition of the feed. However, a pH adjusting composition is optionally used as necessary to adjust and maintain the pH of the aqueous coal slurry prior to and during flotation to a value from about 4 to about 8, preferably about 4 to about 7, which normally promotes the greatest coal recovery. If the coal is acidic in character, the pH adjusting composition can operably be an alkaline material, such as soda ash, lime, ammonia, potassium hydroxide or magnesium hydroxide, with sodium hydroxide being preferred. If the aqueous coal slurry is alkaline in character, a carboxylic acid such as acetic acid, or a mineral acid such as sulfuric acid or hydrochloric acid are operable to adjust the pH.

The conditioned and pH-adjusted aqueous coal slurry is aerated in a conventional flotation machine or bank of rougher cells to float the coal. Any suitable rougher flotation unit can be employed.

The practice of the process of the instant invention can be used alone to beneficiate coal. Alternatively, the process can be used in conjunction with secondary flotations following the instant process to effect even greater beneficiation of the coal.

SPECIFIC EMBODIMENTS

The following examples are included for illustration and do not limit the scope of the invention or claims. Unless otherwise indicated, all parts and percentages are by weight.

In the following examples, the performance of the frothing processes described is shown by giving the rate constant of flotation and the amount of recovery at infinite time. These numbers are calculated by using the formula $$\gamma = R_\infty \left[ 1 - \frac{1 - e^{-kt}}{kt} \right]$$

wherein: $\gamma$ is the amount of mineral recovered at time t, k is the rate constant for the rate of recovery and $R_\infty$ is the calculated amount of the mineral which would be recovered at infinite time. The amount recovered at various times is determined experimentally and the series of values are substituted into the equation to obtain the $R_\infty$ and k. The above formula is explained in Klimpel "Selection of Chemical Reagents for Flotation", Chapter 45, pp. 907–934, Mineral Processing Plan Design, 2nd Ed., 1980, AIME (Denver) (incorporated herein by reference).

EXAMPLE 1

Froth Flotation of Coal

The frothers of this invention are used to float coal using 0.2 lb/ton of frother in separate tests and 1 lb/ton of the collector Soltrol®.

Experimental Procedure

The major coal tested is a bituminous Pittsburgh Seam coal which is slightly oxidized, which is a good test coal for reagent evaluation and comparisons, as it exhibits very typical (average) coal flotation characteristics. The coal, as received, is passed through a jaw crusher and then screened through a 25 mesh sieve. The coarse portion is passed through a hammer mill. The two streams are combined, blended, and then split successively into 200-g packages, and stored in glass jars. The ash content, determined by ignition loss at 750° C., is 27.5 percent. Two large batches of coal are prepared for testing, and sieve analysis shows 15.5 percent coarser than 35 mesh, 53.5 percent of between 35 and 170 mesh, and 31.0 percent finer than 170 mesh.

The flotation cell used is a Galigher Agitair 3 in 1 Cell. The 3000 cc cell is used and is fitted with a single blade mechanized froth removal paddle that revolves at 10 rpm. The pulp level is maintained by means of a constant level device that introduces water as the pulp level falls.

The 200-g sample of coal is conditioned in 2800 cc of deionized water for 6 minutes with the agitator revolving at 900 rpm. The pH is measured at this time, and typically is 5.1. After the 6-minute conditioning period, the collector is added (Soltrol® purified kerosene); after a one-minute conditioning period, the frother is added; after another one-minute conditioning period, the air is started at 9 liters/minute and the paddle is energized. The froth is collected after 3 paddle revolutions (0.3 minute), after 3 additional revolutions (0.6 minute), after 4 more revolutions (1.0 minute) and at 2.0 and 4.0 minutes. The cell walls and the paddle are washed down with small squirts of water. The concentrates and the tail are dried overnight in an air oven, weighed, and then sieved on a 35 mesh and 170 mesh screen. Then ash determinations are run on each of the three sieve cuts. In cases where there are large quantities in a cut, the sample is split with a riffle splitter until a small enough sample is available for an ash determination. The weight versus time is then calculated for the clean coal as well as the ash for each flotation run. The results are contained in Table I. R-4 minutes is the experimentally determined recovery associated with 4 minutes of flotation. The experimental error in R-4 minutes is ±0.015.

In Tables I and II, DF-400 refers herein to DOWFROTH® 400 (Trademark of The Dow Chemical Company) which is a polypropylene glycol with an average molecular weight of about 400. VORANOL® 2025 (Trademark of The Dow Chemical Company) refers herein to the reaction product of 1,2,3-trihydroxy propane (glycerol) and propylene oxide with an average molecular weight of 250. VORANOL® CP 450 refers herein to the reaction product of 1,2,3-trihydroxy propane (gylcerol) and propylene oxide with an average molecular weight of 450. VORANOL® 2070 refers herein to the reaction product of 1,2,3-trihydroxy propane (glycerol) and propylene oxide with an average molecular weight of 700. VORANOL® 360 refers herein to the reaction product of propylene oxide and a mixture of sucrose and glycerine which has an average molecular weight of 702, an equivalent weight of 156 and a 4.5 functionality. VORANOL® 490 refers herein to the reaction product of propylene oxide and a mixture of sucrose and glycerine which has an average molecular weight of 518, an equivalent weight of 115 and a 4.5 functionality. VORANOL® 446 is the reaction product of propylene oxide and a mixture of sucrose and glycerine which has an average molecular weight of 567, an equivalent weight of 126 and a functionality of 4.5. VORANOL® 370 is the reaction product of propylene oxide with a mixture of sucrose and VORANOL® 490 which has an average molecular weight of 1049, an equivalent weight of 152 and a 6.9 functionality. Sucrose-PO 160 refers herein to the reaction product of sucrose and propylene oxide with an equivalent weight of 160. Sucrose-PO 123 refers herein to the reaction product of sucrose and propylene oxide with an equivalent weight of 123. Sorbitol-PO 127 refers herein to the reaction product of sorbitol and propylene oxide with an equivalent weight of 127. Sucrose-PO 106 refers herein to the reaction product of sucrose and propylene oxide with an equivalent weight of 106. Equivalent weight is the average molecular weight divided by the functionality, the number of hydroxy groups per molecule.

TABLE I

| | Coal | | | | | Ash | | | | | |
|---|---|---|---|---|---|---|---|---|---|---|---|
| | Total | | R-4 | R-4 | R-4 | Total | | R-4 | R-4 | R-4 | Selectivity[1] |
| Frother | K | R | +35 | 35 × 170 | −170 | K | R | +35 | 35 × 170 | −170 | −170 |
| Voranol 2070 | 4.7 | 0.357 | 0.042 | 0.175 | 0.777 | 2.0 | 0.122 | 0.012 | 0.056 | 0.259 | 3.0 |
| CP 450 | 13.1 | 0.651 | 0.322 | 0.481 | 0.898 | 6.8 | 0.144 | 0.028 | 0.108 | 0.182 | 4.9 |

[1]Selectivity is $\frac{\text{R(4 min.) for } -170 \text{ mesh coal}}{\text{R(4 min.) for } -170 \text{ mesh ash}}$ Table I demonstrates that the frothers of this invention show high selectivity toward the −170 mesh coal over the −170 mesh ash while giving a reasonably high total coal recovery and reasonably high −170 mesh coal recovery.

EXAMPLE 2

Flotation of Coal

A series of froth flotation experiments on coal using the novel frothers of this invention is run using the same procedure as described in Example 1. The results are compiled in Table II. The experimental error in R-4 minutes is ±0.015. The coal used has a particle size distribution of 5.4 percent greater than 35 mesh, 63.5 percent with a particle size of between about 35 and 170 mesh, and 31.1 percent with a particle size less than 170 mesh.

TABLE II

| | Coal | | | | | Ash | | | | | |
|---|---|---|---|---|---|---|---|---|---|---|---|
| | Total | | R-4 | R-4 | R-4 | Total | | R-4 | R-4 | R-4 | Selectivity[1] |
| Frother | K | R | +35 | 35 × 170 | −170 | K | R | +35 | 35 × 170 | −170 | −170 |
| DF-400[2] | 6.3 | 0.945 | 0.518 | 0.893 | 0.965 | 5.5 | 0.268 | 0.035 | 0.255 | 0.418 | 2.3 |
| Voranol 2025 | 8.5 | 0.367 | 0.153 | 0.344 | 0.465 | 9.5 | 0.061 | 0.015 | 0.063 | 0.080 | 5.8 |
| Voranol[3] 2025 + DF-400 | 6.8 | 0.839 | 0.354 | 0.778 | 0.933 | 6.1 | 0.181 | 0.020 | 0.173 | 0.326 | 2.9 |
| CP 450 | 6.6 | 0.908 | 0.455 | 0.862 | 0.948 | 5.8 | 0.232 | 0.034 | 0.215 | 0.263 | 3.6 |
| CP 450[3] + DF-400 | 7.1 | 0.926 | 0.487 | 0.882 | 0.962 | 5.5 | 0.256 | 0.040 | 0.241 | 0.402 | 2.4 |
| Voranol 2070 | 4.8 | 0.819 | 0.275 | 0.742 | 0.908 | 4.3 | 0.148 | 0.016 | 0.129 | 0.264 | 3.4 |
| Voranol[3] 2070 + DF-400 | 7.3 | 0.896 | 0.430 | 0.849 | 0.962 | 7.0 | 0.217 | 0.026 | 0.211 | 0.391 | 2.2 |
| Voranol 360 | 8.2 | 0.797 | 0.332 | 0.745 | 0.912 | 7.2 | 0.161 | 0.024 | 0.142 | 0.259 | 3.5 |
| Voranol 370 | 4.6 | 0.613 | 0.156 | 0.510 | 0.771 | 4.3 | 0.096 | 0.013 | 0.074 | 0.143 | 5.4 |
| Voranol 446 | 6.4 | 0.699 | 0.244 | 0.618 | 0.874 | 7.1 | 0.128 | 0.014 | 0.116 | 0.223 | 3.9 |
| Voranol 490 | 9.7 | 0.698 | 0.306 | 0.630 | 0.855 | 8.6 | 0.146 | 0.027 | 0.137 | 0.206 | 4.2 |
| Sucrose-PO 160 | 5.6 | 0.516 | 0.106 | 0.438 | 0.725 | 4.7 | 0.077 | 0.008 | 0.065 | 0.139 | 5.2 |
| Sucrose-PO 123 | 8.3 | 0.709 | 0.266 | 0.653 | 0.853 | 4.0 | 0.154 | 0.028 | 0.131 | 0.241 | 3.5 |
| Sorbitol-PO 127 | 8.6 | 0.823 | 0.352 | 0.770 | 0.915 | 6.6 | 0.173 | 0.026 | 0.155 | 0.272 | 3.4 |
| Sucrose-PO 106 | 6.1 | 0.500 | 0.174 | 0.425 | 0.674 | 6.1 | 0.072 | 0.015 | 0.054 | 0.122 | 5.5 |

[1]Selectivity is $\frac{\text{R(4 min.) for } -170 \text{ mesh coal}}{\text{R(4 min.) for } -170 \text{ mesh ash}}$

[2]Not an embodiment of this invention

[3]50:50 weight percent blend

Table II demonstrates that the frothers of this invention give good selectivity for the fine particle coal over the fine particle ash. It is further demonstrated that those reaction products with molecular weights of 450 and 700 give good total coal recovery, good fine coal recovery (−170 mesh) and good selectivity. Thus, there is a maximum recovery and selectivity wherein the molecular weight of the reaction product is 450 or 700. Further, Example 2 shows that the frothers of this invention can be blended with commercial frothers known in the art to give improved recovery of fine particles with good selectivity for the fine particles of coal over the fine particles of ash.

What is claimed is:

1. A process for recovering coal from raw coal which comprises (a) subjecting the raw coal in the form of an aqueous pulp to a flotation process in the presence of a flotation collector and a flotation frother under conditions such that the coal having a particle size of greater than 90 micrometers is recovered in the floated froth; and (b) subjecting the tailings containing coal having a particle size of less than about 90 micrometers to a flotation process in the presence of a flotation collector, and a flotating amount of a flotation frother which comprises the reaction product of a polyhydroxy compound which corresponds to the formula $R(OH)_m$ wherein R is a $C_{1-20}$ alkane, sucrose, a monosaccharide, disaccharide or $C_{3-20}$ cycloalkane and m is an integer of about 3 to 10; and propylene oxide, or a mixture of propylene oxide and ethylene oxide wherein the mixture comprises at least 50 mole percent propylene oxide, under conditions such that the coal of a fine particle size is selectively recovered.

* * * * *